United States Patent [19]

Sewell

[11] Patent Number: 4,850,252

[45] Date of Patent: Jul. 25, 1989

[54] SKI EDGE TUNER

[76] Inventor: Mark S. Sewell, 4611 Quail Hollow Ct., Fair Oaks, Calif. 95628

[21] Appl. No.: 226,899

[22] Filed: Aug. 1, 1988

[51] Int. Cl.[4] ..... A63C 11/06; B23D 67/12

[52] U.S. Cl. ..... 76/83

[58] Field of Search ..... 76/83, 82, 82.1, 82.2, 76/88; 51/205 WG; 280/809; 30/286, 287, 294; 29/76 R, 78, 80

[56] References Cited

U.S. PATENT DOCUMENTS

| | | | |
|---|---|---|---|
| 978,356 | 12/1910 | Chaille . | |
| 3,621,571 | 10/1970 | Gern . | |
| 3,968,345 | 7/1976 | Kollmeder . | |
| 3,991,429 | 11/1976 | Honauer . | |
| 4,089,076 | 5/1978 | Sparling | 7/158 |
| 4,121,484 | 10/1978 | Görlach et al. | 76/83 |
| 4,241,624 | 12/1980 | Strojny | 76/83 |
| 4,280,378 | 7/1981 | Levine | 76/83 |
| 4,601,220 | 7/1986 | Yurick, Jr. | 76/83 |
| 4,663,993 | 5/1987 | Weninger | 76/83 |

FOREIGN PATENT DOCUMENTS

| | | | |
|---|---|---|---|
| 3313367 | 8/1984 | Fed. Rep. of Germany | 280/809 |
| 661876 | 8/1987 | Switzerland | 76/83 |

*Primary Examiner*—Roscoe V. Parker

*Attorney, Agent, or Firm*—Jones, Tullar, & Cooper

[57] ABSTRACT

A ski edge tuner uses separately adjustable base and side edge tuning tool holding bodies, which are each pivotably carried by a common base platform, to sharpen and, if desired, bevel the metal edge surfaces of a ski. Bevel angles for each tool holding body, and hence for each ski tuning tool are individually selectable using bevel angle adjusting blocks which slide on wedging surfaces formed in the base platform of the ski edge tuner. Base and side surface tuning tools are carried in recesses in the ski edge tuner and can be quickly and easily removed.

15 Claims, 3 Drawing Sheets

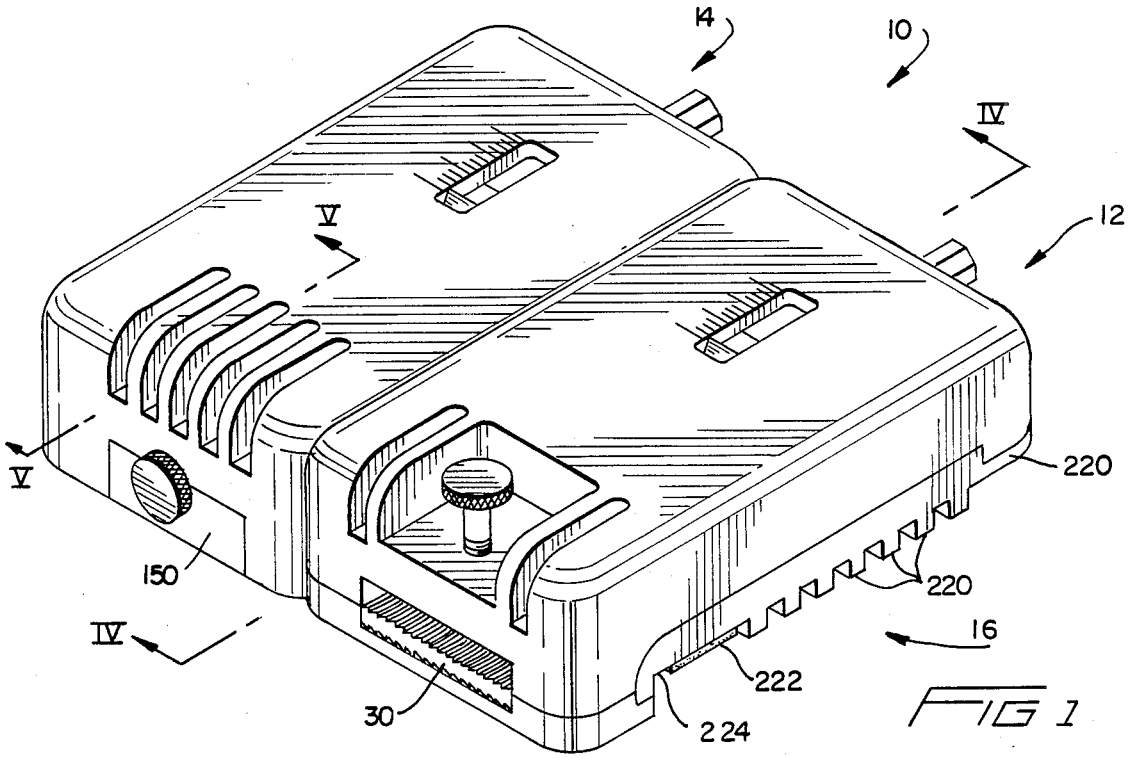
FIG 1
FIG 2
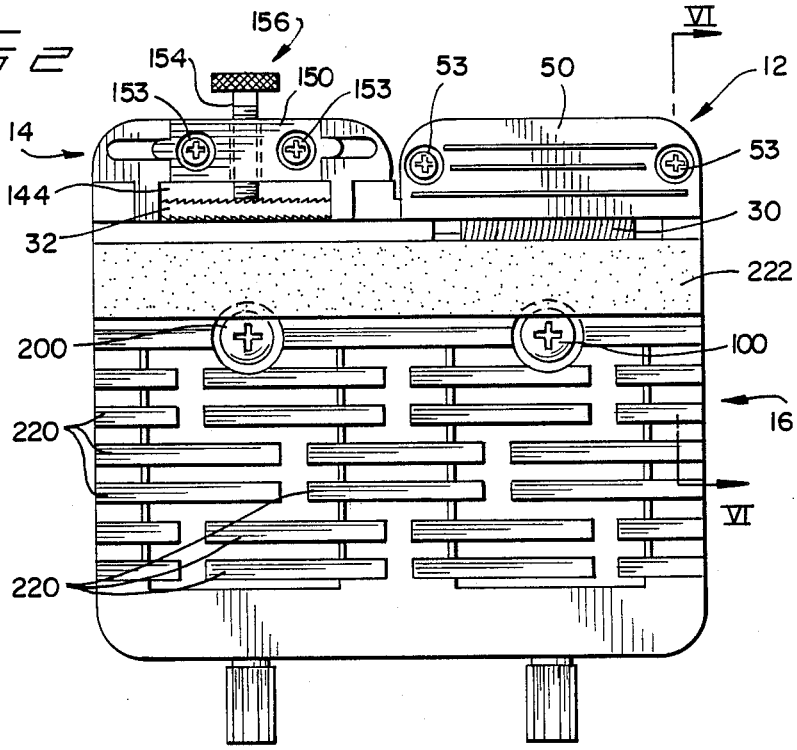

SKI EDGE TUNER

FIELD OF THE INVENTION

The present invention is directed generally to a ski edge tuner. More particularly, the present invention is directed to a ski edge tuner which can concurrently tune the base and side edges of a ski. Most specifically, the present invention is directed to a ski edge tuner in which beveled angles for base and side edge surfaces are independently adjustable. This independent adjustment of both the base and side edge bevel angles allows the user of the ski tuner to properly tune his ski edges for optimum performance based on his ability levels and snow conditions. The ski edge tuner uses a wedge adjustment for both the base edge and side edge sharpening or tuning tools. This highly accurate and reliable wedge adjustment provides a ski edge tuning tool which is effective and which provides excellent results.

DESCRIPTION OF THE PRIOR ART

Modern snow skis are technically sophisticated pieces of sports equipment which are designed to provide every level of skier, from beginning recreational skier to advanced or expert ski racer, with the type of equipment which his or her skiing ability is best able to use. While these various skis use a wide variety of materials, structures, and construction techniques to achieve various types of stiffness, flexure, torsional rigidity and the like, they virtually all have metal edges which are positioned at the junctures of the base and the sides of the ski. As is well known to most skiers and certainly to those skiers who want to optimize their performance, the proper tuning or sharpening of these metal ski edges is very important.

The metal ski edge must be sharp and may also be beveled for best results. The purpose of beveling the ski's edge is to match the ski's performance with the skier's ability and the snow conditions. Beveling of the base edge is important because it allows the ski to more easily initiate a turn. Beveling of the base edge of the tip of the ski will also prevent so-called "hooking" of the ski. This slight bevel of the base edge portion of the metal edge keeps the sharp edge of the ski, and particular of the ski tip, from making contact with the snow until the ski is tipped on edge for turning. Beveling of the side edge of the ski is done for the purpose of adjusting the sharpness of the tip of the edge formed at the apex of the base and side edges. The sharper this tip of the edge, the more bite the ski will have in hard snow and icy conditions. Thus base edge beveling is done to establish how easily the ski will turn while side edge beveling is done to adjust the sharpness of the bite of the ski.

Various ski edge sharpening tools are known in the prior art. These typically utilize some type of metal cutting stone or file which is placed in a holder that is structured to make contact with the base or side of a ski. Exemplary of such prior art devices is the ski edge tuning tool shown in prior U.S. Pat. No. 4,601,220 to Yurick, Jr. This device uses a single file to file the metal side edge of the ski. This prior art device has only one tool and also has no means to bevel the edge to a desired angle.

The prior art contemplates the use of separate cutting tools in a single holder to remove metal from both the base and side surfaces of the ski edge at the same time. Exemplary of these prior art devices is the ski sharpener shown in U.S. Pat. No. 4,280,378 to Levine. This apparatus uses fixed cutting tools rigidly attached to a housing to operate on the base and side edges of a ski as the tool is moved along the base surface of the ski. This prior art device does not allow one to vary the bevel angle of either the base or side surfaces of the ski edge but instead provides a fixed relationship between the two cutting tools.

There are also available edge sharpening tools which provide adjustment mechanisms by which the bevel angle of a single cutting or honing tool may be adjusted. These prior art devices do not allow the user to finely or precisely adjust the bevel angle of the tool. Additionally, these prior art devices may not allow the user to accurately reproduce a previously set bevel angle. Further, these prior devices do not provide a way to concurrently bevel both base and side edge surfaces.

The prior art ski tuning tools have not kept pace with the increasing sophistication of ski makers and skiers. These prior art devices are typically rather crude substitutes for a hand-held file. They do not provide a ski edge tuning tool which will allow both the professional ski tuner and the avid skier to accurately, properly and quickly tune skis. In marked contrast, the ski edge tuner of the present invention provides such a tool and is a significant advance in the art.

SUMMARY OF THE INVENTION

It is an object of the present invention to provide a ski edge tuner.

Another object of the present invention is to provide a ski edge tuner which engages both surfaces of a ski edge.

A further object of the present invention is to provide a ski edge tuner having bevel adjustments.

Yet another object of the present invention is to provide a ski edge tuner which allows accurate independent settings of base and side surface bevels.

Still a further object of the present invention is to provide a ski edge tuner having windows which show the bevel positions of the base and side surface files or stones.

Even yet another object of the present invention is to provide a ski edge tuner having a magnetic strip for retention of edge filings.

Still even a further object of the present invention is to provide a ski edge tuner that is durable, compact, and highly effective.

As will be discussed in greater detail in the description of the preferred embodiment which is set forth subsequently, the ski edge tuner in accordance with the present invention is useable to concurrently sharpen and to bevel, if desired, both the base and side surfaces of a metal ski edge portion of a downhill ski. This is accomplished by providing a base tool holder and a side tool holder adjacently attached to a base platform. Each tool holder is independently adjustably pivotable with respect to the base platform and is accurately adjustable by use of a wedge adjusting device. The angular positions of the base surface tool and side surface tool are each shown in windows provided in the respective tool holders. The base platforms has a large area ski base contacting surface and carries a magnetic strip in a recess. This base platform provides stable support for the two adjacent tool holders and the magnetic strip picks up metal particles which might otherwise damage the plastic base of the ski.

The ski edge tuner of the present invention is clearly significantly faster and better than the prior art devices. Since it uses two cutting or honing tools, both the base and side surfaces of the metal ski edge will be tuned or sharpened during each pass of the ski edge tuner along the base of the ski. This makes ski tuning faster than could be accomplished using the prior single tool devices. A second benefit of using these two tools of the present invention is the reduction or avoidance of edge burring which is common with single tool devices. The leading file creates an edge burr which is substantially entirely removed by the trailing tool. While the trailing tool may create a second edge burr, this is minimal in size and at the completion of the sharpening process, the sharpened edge is essentially burr free.

Each of the ski tuning tool holders of the present invention is supported on the base platform by a wedge adjustment device which is screw actuated. Rotation of the bevel angle adjusting screws for each of the tool holders will allow the bevel angle of each of the cutting or honing tools to be accurately selected with respect to the base platform. The amounts of bevel imparted to the base and side surfaces of the ski edge can thus be independently adjusted in accordance with the wishes of the individual skier. Equally importantly, these settings can be accurately reproduced. This means that a skier can tune his skis using a particular pair of bevel settings, can then try the skis, and can either re-tune to the same bevels or can change these bevels in an accurate manner.

The cutting or honing files or stones are easily and quickly changeable in the ski edge tuner of the present invention. The working surfaces of these files or stones are also exposed for easy cleaning and visual inspection. Since the base platform surface which contacts, and slides on the ski surface has a large area, the ski edge tuner is very stable and easy to use, even for the beginning skier or ski tuner. The magnetic strip positioned in a recess in the base platform picks up edge filings before they can damage the base surface of the ski.

The ski edge tuner of the present invention provides an effective tool for use in sharpening the edges of a ski and for imparting a bevel, if desired, to these edges. It affords accurate, reproducible edge beveling and insures that the skier or ski tuner will be able to tune skis to maximize their performance and to match the ski's performance with the ability and desires of the skier. As will be readily apparent to those knowledgeable in this art, the ski edge tuner of the present invention is a significant advance in the art and provides a highly satisfactory ski tuning device.

BRIEF DESCRIPTION OF THE DRAWINGS

While the novel features of the ski edge tuner in accordance with the present invention are set forth with particularity in the appended claims, a full and complete understanding of the invention may be had by referring to the detailed description of the preferred embodiment which is set forth subsequently, and as is illustrated in the accompanying drawings in which:

FIG. 1 is a perspective view of the ski edge tuner of the present invention;

FIG. 2 is a bottom plan view of the ski edge tuner;

DESCRIPTION OF THE PREFERRED EMBODIMENT

Figure 3:
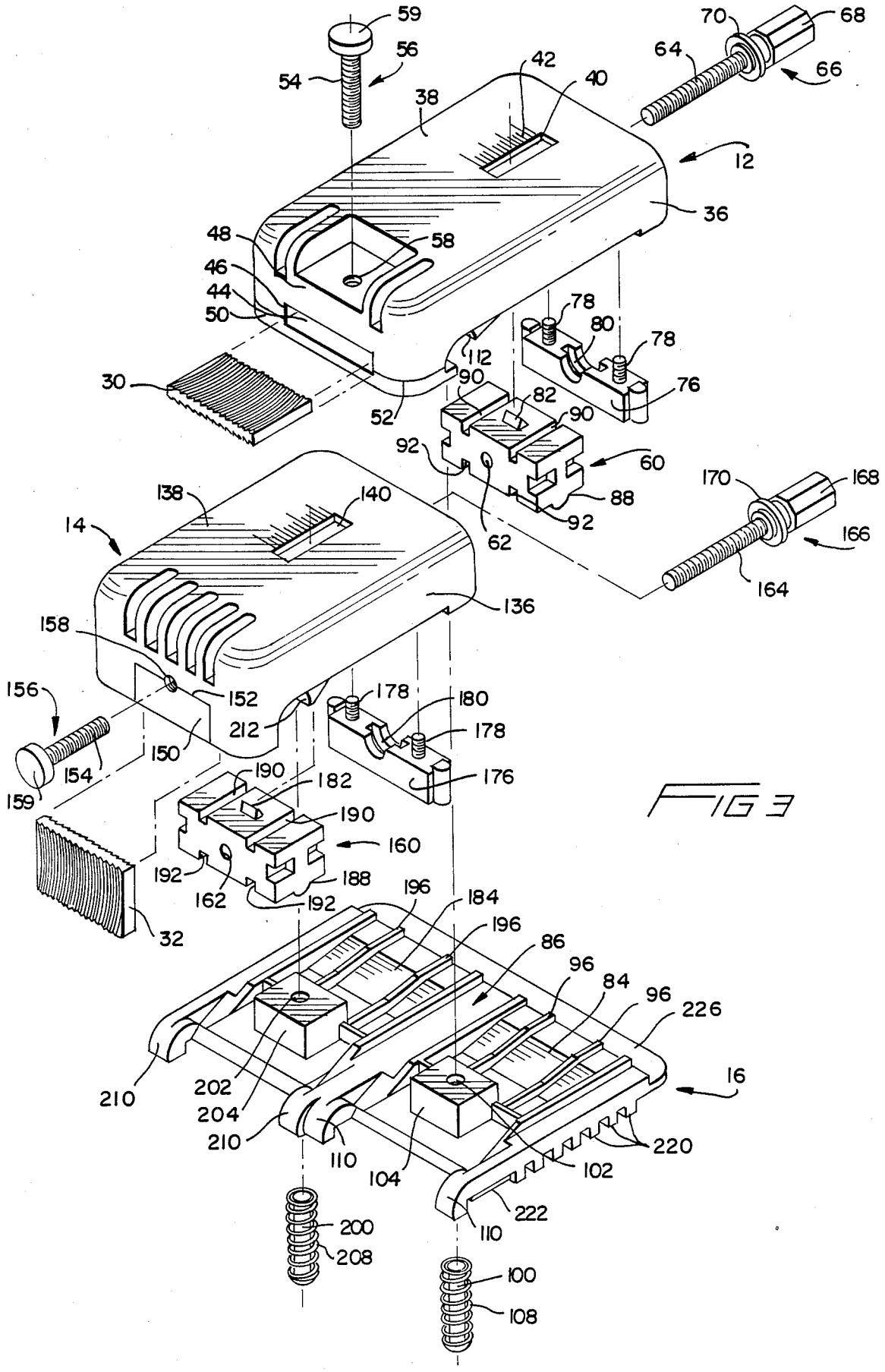
FIG. 3 is an exploded perspective view of the ski edge tuner.

Referring initially to FIG. 1, there may be seen a preferred embodiment, generally at 10, of a ski edge tuner in accordance with the present invention. Ski edge tuner 10 is comprised generally of a ski edge base surface tuning tool holder 12, a ski edge side surface tuning tool holder 14, and a ski edge tuner base platform 16. The base surface tool holder 12 and the side surface tool holder 14 are pivotably mounted on the base platform 16, as will be discussed in detail shortly, and cooperate to sharpen and bevel both the base surface portion 18 and the side surface portion 20 of a metal edge strip 22 which is positioned at the outer edges of the base 24 of a downhill ski 26, as is depicted schematically in FIGS. 4 and 5. In the preferred embodiment, the base and side surface tool holders 12 and 14, and the base platform 16 are all molded from a suitable plastic material.

Figure 4:
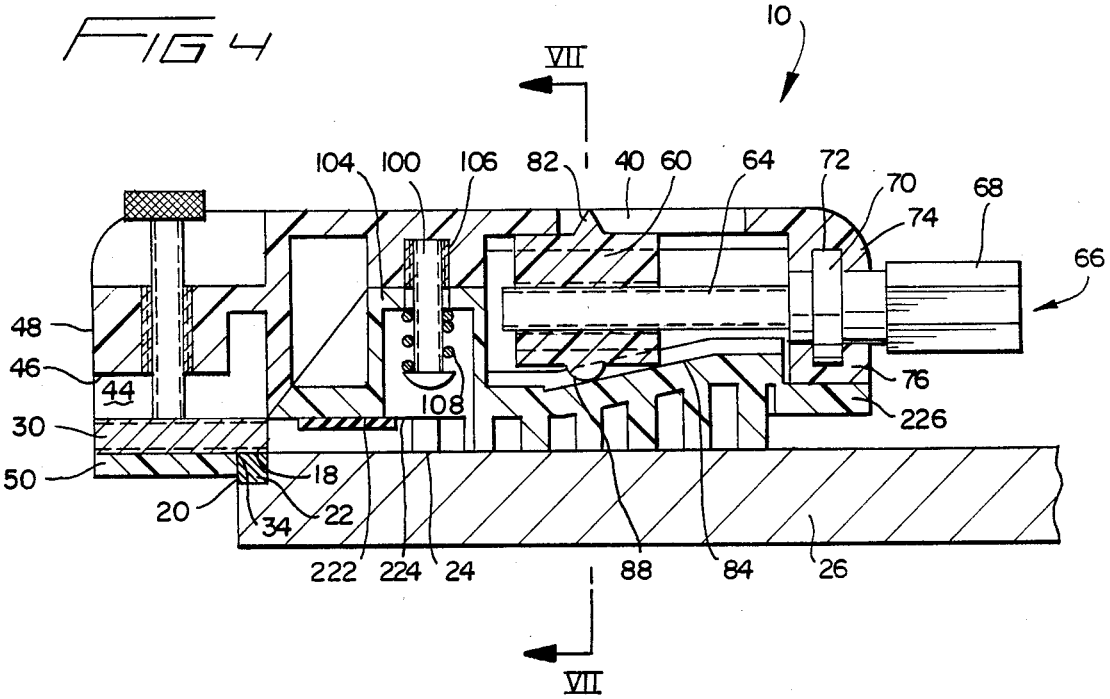
FIG. 4 is a cross-sectional side elevation view of the ski edge tuner taken along line IV—IV of FIG. 1 and showing the ski edge base surface tuning portion of the device.
Figure 5:
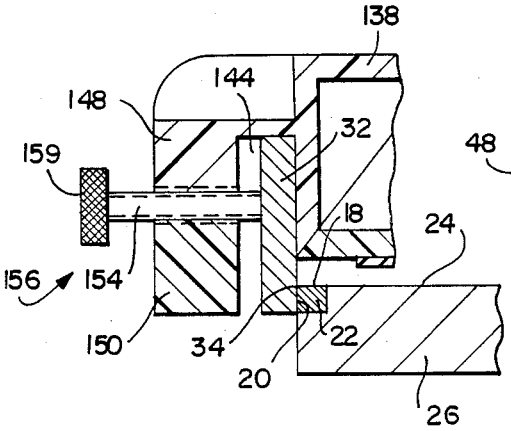
FIG. 5 is a cross-sectional side elevation view of a segment of the ski edge side surface tuning portion of the device taken along line V—V of FIG. 1.

As discussed previously, and as may be seen most clearly in FIGS. 1 and 2, base surface tuning tool holder 12 removably carries a base surface tuning tool 30, and side surface tuning tool holder 14 removably carries a side surface tuning tool 32. These base and side surface tuning tools 30 and 32, respectively may be files, honing stones or similar tools which will effectively modify the base and side surfaces 18 and 20, respectively of metal ski edge strip 22. With the ski edge tuner 10 of the present invention positioned on the base surface 24 of ski 26, as shown in FIG. 4, movement of the tuner 10 longitudinally along the base surface 24 will concurrently allow the user of the ski edge tuner 10 to sharpen and bevel both the base surface 18 and the side surface 20 of metal ski edge 22. This effects a sharpening of a tip portion 34 of the metal ski edge 22. As is well known to those who ski, the sharpness of edge tip 34 has a significant effect of the performance of one's skis. As will also be discussed in detail shortly, the ski edge tuner 10 of the present invention also allows concurrent beveling of the base surface 18 and side surface 20 of the metal edge strip 22. This ability to both sharpen and bevel the tip 34 of ski metal edge strip 22 makes the ski edge tuner 10 of the present invention a particularly useful ski tuning tool.

Turning now to FIG. 3, the structures of the three elements of the ski edge tuner 10 and their individual components may be seen in more detail. Ski edge base tuning tool holder, generally at 12, utilizes a generally rectangular base tuning tool holder body 36. This body 36 has a generally planar upper surface 38 in which is formed a bevel position window 40 that is bounded on one side by a bevel indicating scale 42 whose scale increments are set off in quarter degrees of bevel. Base surface tuning tool 30 is receivable in a base surface tuning tool receiving pocket 44. This base tool receiving pocket 44 is formed by a recess 46 in a front surface 48 of base tool holder body 36, and a cooperating base surface tool holder plate 50. As may be seen in FIG. 2, the base surface tool holder plate 50 is secureable to the undersurface 52 of base tool holder body 36 by suitable screws 53. Alternately, base tool holding recess 44 could be formed as one piece during molding of base tool holder body 36.

A threaded shank portion 54 of a base tool clamping screw 56 is received in a threaded bore 58 formed in base tool holder body 36 generally overlying and centered with respect to base tool receiving pocket 44. If desired, threaded bore 58 may be provided with a molded in place threaded metal bushing (not shown) so that the threads in bore 58 will not wear. Base tool clamping screw 56 has an enlarged head 58 which may have a knurled surface to facilitate gripping. Once base surface tuning tool 30 has been placed in pocket 44, it may be clamped in place by tightening clamping screw 56 down onto tool 30. It will be understood that tool 30 and pocket 44 are cooperatively dimensional so that tool 30 will not be able to rotate or slip unduly in pocket 44. At the same time, tool 30 should be easy to insert into and remove from pocket 44. As may be seen most clearly in FIGS. 2 and 4 it will also be appreciated that the depth of pocket 44, the depth of base surface tool holder plate 50, and the depth of base surface tool 30 are interrelated such that the inner lower surface of tool 30 is exposed and can contact base surface 18 of metal edge strip 22 when ski edge tuner 10 is placed on ski base 24.

A base bevel angle adjusting block 60 is used to adjust the angular position of base tuning tool holder 12 and hence of base tuning tool 30 with respect to base platform 16. This base bevel angle adjusting block 60, as seen most clearly in FIGS. 3 and 4 is positioned beneath the upper surface 38 of base tool holder body 36 and is slidable tranversely to the base 24 of the ski 26. Adjusting block 60 is generally rectangular and has a central threaded bore 62. This bore 62 receives a threaded shank portion 64 of a base bevel angle adjusting screw, generally at 66. This screw 66 has an enlarged head 68 which may be shaped to facilitate gripping. Interiorly of its enlarged head 68, base bevel adjusting screw 66 is provided with an enlarged diameter flange 70. This flange is receivable in a cooperatively shaped annular recess 72 which is formed in a rear wall 74 of base tool holder body 36. A base journal block 76 is secured by screws 78 to the undersurface of the rear wall 74 of the base tool holder body 36. This base journal block 76 has a recess 80 which cooperates with recess 72 in rear wall 74 to form a closed chamber that receives flange 70 on adjusting screw 66. Thus, as may be seen most clearly in FIG. 4, rotation of adjusting screw 66 will cause base bevel angle adjusting block 60 to move transversely within base tool holder body 36 with respect to the ski 26 on which ski edge tuner 10 may be positioned.

Base bevel angle adjusting block 60 has a bevel angle indicator 82 formed on its upper surface. This indicator 82 extends upwardly through base bevel position window 40 and provides an indication of the base bevel angle provided by movement of base bevel angle adjusting block 60. Such bevel angle adjustment is accomplished through the cooperation of a base wedging surface 84 on an upper face 86 of base platform 16 and a rounded wedging surface follower 88 on the undersurface of base bevel angle adjusting block 60. As may be seen most clearly in FIG. 4, when base bevel adjusting screw 66 is rotated, base bevel angle adjusting block 60 will move up or down along base wedging surface 84 of base platform 16. Adjusting block 60 is guided in this movement by upper and lower guide slots 90 and 92 which receive upper guide fins 94 formed in the inner surface of upper portion 38 of base tool holder body 36 and lower guide fins 96 provided in the upper face 86 of base platform 16. These guide slots 90 and 92, and their cooperating guide fins 94 and 96, respectively allow base bevel angle adjusting block 60 to slide along these wedging surface 84 without twisting or rotating.

Referring again primarily to FIGS. 3 and 4, base ski tuning tool holder 12 is pivotably secured to base platform 16. A base securing screw 100 passes upwardly through an aperture 102 in a base securement pedestal 104 which is formed integrally in upper surface 86 of base platform 16. Securement screw 100 passes upwardly into a threaded bore 106 in the undersurface of the upper portion 38 of base tool holder body 36. A coil spring 108 is placed about base securing screw 100 and, as seen most clearly in FIG. 4 engages the undersurface of base securement pedestal 104 to exert a downward force on base securing screw 100.

Figure 6:
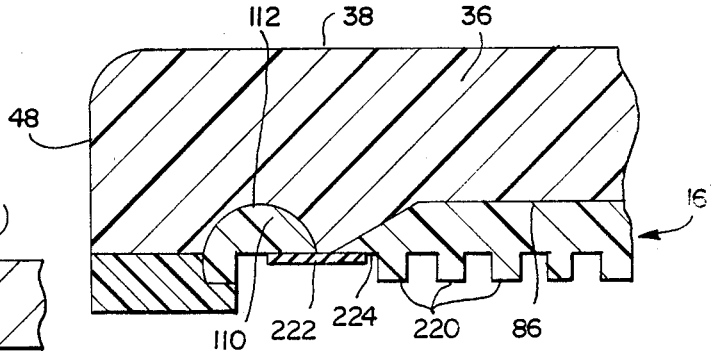
FIG. 6 is a cross-sectional side elevation view of a segment of the ski edge side surface tuning portion of the device taken along line VI—VI of FIG. 2 and showing the pivot assembly of the invention.
Figure 7:
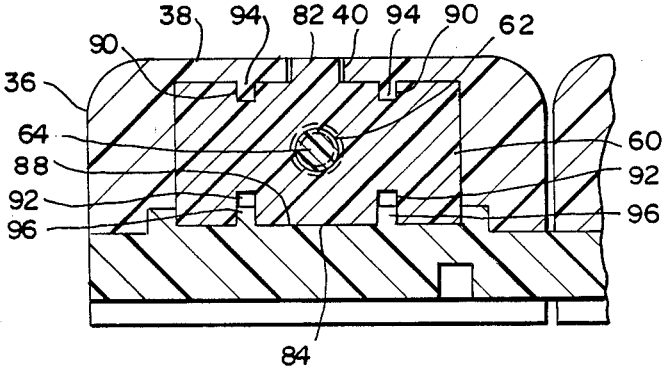
FIG. 7 is a cross-sectional end view of a portion of the ski edge base surface tuner taken along line VII—VII of FIG. 4 and showing the wedge adjustment assembly of the present invention.

Base platform 16 is formed having a pair of arcuate base platform pivot surfaces 110 formed in upper base platform face 86 generally adjacent the front of base platform 16. These base platform pivot surfaces 110 are sized and shaped to fit within base body pivot recesses 112, as may be seen most clearly in FIG. 6, which are provided in the undersurface of upper body portion 38 of base tool body holder 36. These cooperating base pivot surfaces 110 and base pivot recesses 112 form a base body tool holder pivot axis about which base tool holder 12 can pivot with respect to base platform 16. Now again referring to FIG. 4, it will be understood that as base angle adjusting screw 66 is rotated in a clockwise direction to move base bevel angle adjusting block 60 rearwardly, or to the right as seen in FIG. 4, the orientation of base surface tuning tool 30 will change from a horizontal orientation wherein no bevel is imparted to the metal base surface 18, to an inclined orientation in which a selectable bevel amount is imparted to metal base surface 18. Such pivoting of the rear of base tool holder body 36 upwardly by movement of base bevel angle adjusting bevel block 60 to the right, angles the base surface tuning tool's forwardmost end down. This creates a positive bevel on base surface 18 of metal ski edge 22. Such a positive bevel effectively raises the tip 34 of the metal edge strip 22 up away from the snow when ski 26 is placed in its upright use position; i.e., inverted from the position shown in FIG. 4. The force exerted by spring 108 will tend to pull base tool holder body 26 toward base platform 16 so as base bevel angle adjusting screw is turned in a counterclockwise direction to decrease the bevel angle; i.e., to move base bevel adjusting block downwardly on base wedging surface 84, the coil spring 108 will pull the tool holder body 36 down toward the base platform 16.

Base bevel angle selection with the ski edge tuner of the present invention is both accurate and reproducable. The base pivot surfaces 110 on base 16 and the base pivot recesses 112 on base tool holder body 36 have sufficient area to provide good support. The screw cooperation between base bevel angle adjusting block 60 and base bevel angle adjusting screw 66 are positive with no slippage. Base bevel angle adjusting block 60 does not rock or tip on base wedging surface 84. The base bevel angle indicator 82 slides in window 40 and provides an accurate indication of base bevel angle setting. Thus the person using the ski edge tuner of the present invention can repeatedly and accurately select and maintain a desired base metal edge surface bevel.

Ski metal side surface tool holder, generally at 14, is substantially the same in structure and operation as ski metal base surface tool holder, generally at 12, as discussed above. For ease of understanding, corresponding parts in each tool holder have been correspondingly numbered with the parts in the side surface tool holder 14 being increased by an order of one hundred. Thus side surface tool holder 14 has a generally rectangular tool holder body 136 which has an upper body position or surface 138 provided with a side bevel portion window 140 which is bounded by a side bevel indicating scale 142. A significant and clearly necessary difference between these two tool holders is that side surface tool receiving pocket 144, as may be seen most clearly in FIG. 2 opens downwardly. Recess 146, which is formed in the front surface 148 of side tool holder body 136, cooperates with a generally vertically oriented side tool holder plate 150 to form side tool receiving pocket 144. Side tool holder plate 150 is held in place in the forward portion 148 of side tool holder body 136 by suitable screws 153 which pass up through the side tool holder plate 150 and extend into the front portion 148 of side tool holder body 136. A threaded shank 154 of a side tool clamping screw 156 passes through a threaded bore 158 formed at the juncture of the top of side tool holder plate 150 and the top of a slot 152 in which it slides in the front 148 of side tool holder body 136. As may be seen most clearly in FIG. 5, side surface tuning tool 32 is dimensional to fit into recess 144 and to extend down below the level of the undersurface of side tool holder body 136 so that the surface of side tuning tool 32 will contact the side surface 20 of metal edge strip 22 when the ski edge tuner 10 is placed on the base 24 of ski 26.

Adjustment of the bevel angle for side surface tuning tool 32 is accomplished in the same manner as is done with base surface tuning tool 30. Thus it is not necessary to again describe in detail the structure of side bevel angle adjusting block 160, side bevel angle adjusting screw 166, side journal block 176, side wedging surface 184 on base platform 16 and the various other components which are the same for both the base tool holder body 30 and the side tool holder body 136. Side surface tool holder 136 has pivot recesses 212 which cooperate with side surface platform pivot surfaces 210. As may be seen in FIG. 3, the pivot axis for the side tool holder body 136; i.e., side pivot surfaces 210 is offset forwardly from the pivot axis of the base tool holder body 36. This provides an arrangement which is felt to add stability to the ski edge tuner 10 of the present invention.

Ski edge tuner base platform 16 is generally planar, as may be seen in FIG. 3 and as was discussed above, and provides a wide support area for the base and side tool holder bodies 36 and 136, respectively. A plurality of generally parallel base platform support feet 220 are molded or otherwise formed on the bottom of base platform 16. These support feet 220 are discontinuous and staggered as may be seen most clearly in FIG. 2. These support feet 220 contact the base of ski 26, as is shown in FIG. 4 and firmly support ski edge tuner 10 on the ski base 24. An elongated magnetic strip 222 is positively secured in a strip receiving recess 224 which is formed in base platform 16 just inwardly and rearwardly of tuning tools 30 and 32. During use of ski edge tuner 10, any chips or particles of the metal ski edge strip 22 which are generated will be attracted to, and held by magnetic strip 222. These particles held by magnetic strip 222 will thus not become trapped between ski base 24 and base platform support feet 220 so they cannot scratch or gouge the ski base 24.

As may be seen in FIGS. 1, 3 and 4, the rear portion of base platform 16 has a platform flange 226. This flange 226 may contact the undersurfaces of base and side journal blocks 76 and 176, respectively, when the bevel angles are set at 0° bevel. Similarly, the upper surfaces of base and side securement pedestals 104 and 204 on base platform 16 will contact the base and side tool holder bodies 36 and 136 when these bodies are in the 0° bevel position. This cooperation insures that the bevel angles will never be negative angles, even if the bevel angle adjusting blocks 60 and 160 are moved forwardly beyond the point where ski wedging surface followers 88 and 188 may move out of contact with base and side wedging surfaces 84 and 184, respectively. This again insures accurate bevel selection.

In use, the desired base and side surface tuning tools 30 and 32 are placed in their recesses 44 and 144 in base and side tool holder bodes 36 and 136. These tools are hold in place by tightening down base and side clamping screws 56 and 156. The tuning tools may be various files or honing stones, as required by the tuning operation to be performed. Once the tools have been put in place and tightened, the ski edge tuner 10 is placed on the base 24 of the ski 26 with the tools engaging the base and side surface 18 and 20 of the ski edge 22, as seen most clearly in FIG. 4. Now movement of the ski edge tuner 10 along the length of the ski base 24 will tune or sharpen the tip 34 of metal ski edge strip 22. This sharpening operation may initially be performed with both bevel angle adjusting blocks 60 and 160 set at 0 degrees. This will produce a sharp tip edge 34 and a neutral ski. If the skier desires a bevel for his ski edge base surface 18, his ski edge side surface 20, or typically both surfaces, he may accomplish this by setting the angle adjusting blocks 60 and 160 to desired positive bevel angles, as indicated by bevel indicators 82 and 182 in windows 40 and 140. The person tuning the ski 26 can impart a desired positive bevel to either the base edge surface 18, the side edge surface 20 or to both edge surfaces by using the ski edge tuner 10 of the present invention. It will be understood that, as was discussed previously, a positive base surface metal edge bevel is one in which the tip 34 of the metal edge strip 22 is moved upwardly above the surface of the snow when the ski is placed in its use position. For a less aggressive skier, and in usual useage, the amount of base positive bevel and side positive bevel will be the same so that the angle between base surface 18 and side surface 20 is maintained at 90°. An obtuse edge angle such as would occur when the base bevel were, for example, greater than the side bevel would dull the tip edge 34 and would typically only be done by skiers who ski in softer snow. An acute angle wherein the base bevel angle would, for example, be less than the side bevel angle would be desirable in icy conditions and with aggressive skiers. In any case, the ski edge tuner 10 of the present invention allows the selection of various bevels for both base and side surfaces in a very accurate, controllable and reproducable manner. The positive engagement between the bevel angle adjusting blocks 60 and 160 and their wedging surfaces 84 and 184, together with the screw actuation provided by bevel angle adjusting screws 66 and 166 gives microadjustability for the amount of bevel and allows the bevel amount to be adjusted independently for both the base edge and the side edge. This structure and operation provides a ski edge tuner 10 in accordance with the present invention which is highly superior to prior art devices.

While a preferred embodiment of a ski edge tuner in accordance with the present invention has been set forth fully and completely hereinabove, it will be apparent to one of skill in the art that a number of changes in, for example, the particular type of materials used for the body parts of the ski tuner, the overall shape of the device, the particular type of tuning tool used, and the like could be made without departing from the true spirit and scope of the present invention which is accordingly to be limited only by the following claims.

What is claimed is:

1. A ski edge tuner useable to concurrently tune a base surface and a side surface of a metal edge strip of a ski, said ski edge tuner comprising:

a base tool holder adapted to removably receive a base surface tuning tool;

a side tool holder adapted to removably receive a side surface tuning tool;

a ski edge tuner base platform, said base tool holder and said side tool holder being attachable to said base platform; and means for adjustably positioning at least one of said base tool holder and said side tool holder at a bevel angle with respect to said base platform.

2. The ski edge tuner of claim 1 including means for independently adjustable positioning both said base tool holder and said side tool holder to selected bevel angles with respect to said base platform.

3. The ski edge tuner of claim 1 wherein said base tool holder and said side tool holder include tool holder bodies having tuning tool holding pockets.

4. The ski edge tuner of claim 3 wherein said base and said side tuning tools are secured in said pockets by tool clamping screws.

5. The ski edge tuner of claim 1 wherein each said base tool holder and said side tool holder carry bevel angle adjusting blocks.

6. The ski edge tuner of claim 5 wherein said base bevel angle adjusting block and said side bevel angle adjusting block bear against separate wedging surfaces on said base platform.

7. The ski edge tuner of claim 5 wherein said base bevel angle adjusting block and said side angle bevel adjusting block each include a bevel angle indicator.

8. The ski edge tuner of claim 7 wherein each said bevel angle indicator is visible through a bevel position window in said base tool holder and said side tool holder.

9. The ski edge tuner of claim 5 wherein each said base and side bevel angle adjusting blocks are movable with respect to said base and side tool holders by rotation of base and side bevel angle adjusting screws.

10. The ski edge tuner of claim 9 wherein said bevel angle adjusting screws pass through threaded bores in their associated bevel angle adjusting blocks.

11. The ski edge tuner of claim 1 wherein each said base and side tool holders have pivot recesses which cooperate with similarly shaped pivot surfaces on said base platform.

12. The ski edge tuner of claim 11 wherein pivot axes of said base and side tool holders are offset from each other.

13. The ski edge tuner of claim 1 wherein said base platform includes spaced base and side tool holder securement pedestals and further wherein spring encircled securement screws pass through apertures in said pedestals and are secured in said base and side tool holders.

14. The ski edge tuner of claim 1 wherein said base platform has a plurality of base platform support feet which contact a base portion of the ski to be tuned.

15. The ski edge tuner of claim 1 wherein said base platform carries a magnetic strip in a strip receiving recess adjacent said base and side surface tuning tools.

* * * * *